US009500047B2

(12) United States Patent
Brown et al.

(10) Patent No.: US 9,500,047 B2
(45) Date of Patent: Nov. 22, 2016

(54) METHOD AND APPARATUS FOR SUPPORTING A TUBULAR

(71) Applicant: Stingray Offshore Solutions, LLC, Houston, TX (US)

(72) Inventors: Trevor S. Brown, Magnolia, TX (US); Akihito James Fukasawa, Houston, TX (US)

(73) Assignee: Stingray Offshore Solutions, LLC, Houston, TX (US)

( * ) Notice: Subject to any disclaimer, the term of this patent is extended or adjusted under 35 U.S.C. 154(b) by 328 days.

(21) Appl. No.: 14/448,737

(22) Filed: Jul. 31, 2014

(65) Prior Publication Data

US 2015/0034335 A1 Feb. 5, 2015

Related U.S. Application Data

(60) Provisional application No. 61/860,627, filed on Jul. 31, 2013.

(51) Int. Cl.
*E21B 19/10* (2006.01)

(52) U.S. Cl.
CPC ..... *E21B 19/10* (2013.01)

(58) Field of Classification Search
CPC ..... E21B 19/10; E21B 19/07; E21B 19/165; E21B 19/06
See application file for complete search history.

(56) References Cited

U.S. PATENT DOCUMENTS 1,664,461 A * 4/1928 Montgomery ..... E21B 19/07 24/521
2,722,450 A * 11/1955 Nelson ..... E21B 19/06 294/110.1
4,676,312 A 6/1987 Mosing et al.
6,089,338 A 7/2000 Bouligny, Jr.
6,394,201 B1 5/2002 Feigel, Jr. et al.
7,216,717 B2 5/2007 Severin et al.
7,296,630 B2 11/2007 Severin et al.
7,992,634 B2 8/2011 Angelle et al.
8,162,062 B1 4/2012 Barone et al.
8,356,675 B2 1/2013 Pietras et al.
8,590,626 B2 11/2013 Barone et al.
2002/0170720 A1* 11/2002 Haugen ..... E21B 19/00 166/379
2004/0188098 A1* 9/2004 Schulze-Beckinghausen E21B 19/07 166/380
2012/0055682 A1* 3/2012 Bouligny ..... E21B 19/07 166/380
2012/0261528 A1* 10/2012 Stoldt ..... E21B 19/06 248/68.1
2013/0064634 A1 3/2013 Brown et al.

* cited by examiner

*Primary Examiner* — Kipp Wallace
(74) *Attorney, Agent, or Firm* — Haynes and Boone, LLP

(57) ABSTRACT

A spider and method for supporting a tubular within a well bore. Radial dogs, controlled by cylinders that extend and retract simultaneously, are operable to support the tubular by the lower lip of a box connector. When a tubular connector is set down upon the dogs so as to depress one or more triggers located thereon, an interlock in a control system is actuated to prevent movement of the dogs. However, even while the spider is thus loaded, the dogs may nevertheless be retracted via an emergency override mechanism thereby allowing the tubular to be dropped into the wellbore. When the tubular has been lifted off of the triggers, the interlock is deactivated, and the dogs of the spider can be operated once again. The triggers may actuate sensor valves located within the dogs, which in turn actuates an interlock valve isolating the flow path of the cylinders.

16 Claims, 12 Drawing Sheets

METHOD AND APPARATUS FOR SUPPORTING A TUBULAR

CROSS-REFERENCE TO RELATED APPLICATIONS

This is a non-provisional application of co-pending U.S. Provisional Application No. 61/860,627 filed on Jul. 31, 2013, the benefit of which is claimed and which incorporated herein in its entirety.

BACKGROUND

1. Field of the Invention

This invention relates generally to drilling equipment used particularly in the hydrocarbon production industry, and specifically to a spider system and method for running or raising tubulars in a well.

2. Background Art

In the hydrocarbon production industry, tubular goods, including drill strings, casings and tubing, referred to simply as tubulars, must at varying stages be run, i.e. lowered, into or raised from a well. An elevator is a device that is carried by the drilling rig's traveling block or a top drive, which supports the tubular for the purpose of raising or lowering it. An elevator may clamp along the side of a tubular using slips and dies to exert a radial clamping force on the tubular wall, or an elevator may use a bushing to support the tubular at the lower lip of a box connector.

A spider, much like an elevator, is a device which supports a tubular to prevent it from descending into a well when it is not held by an elevator. Unlike an elevator, however, a spider is designed to remain on the drilling deck and is typically not moved vertically. When the elevator, suspended by the traveling block, nears its high limit of travel (when raising a tubular) or its low limit or travel (when running a tubular), or when a stand is required to be added or removed, the elevator must be repositioned in order to continue the operation. The spider supports the tubular prior to the elevator releasing the tubular. Thus, the tubular is held in place while the elevator is repositioned. Once the elevator carries the tubular at a new location, the spider is disengaged allowing the tubular to freely pass through the spider or for the spider to be moved completely clear of the tubular.

Some elevators and spiders used today employ power operated internal mechanisms, e.g., power doors and/or power slips. The powered elevators and spiders are commonly hydraulic, but can be pneumatic or electric.

SUMMARY OF THE INVENTION

As described herein, exemplary embodiments of the spider described herein are designed for well control scenarios in order to provide a safe method of operating over the well bore. In certain embodiments, the spider sits directly over a rotary table. There are a number of radially disposed dogs controlled by cylinders that extend and retract simultaneously about a tubular or joint of pipe going through the wellbore at the drill floor. When the dogs are extended about the tubular, the spider is operable to support the tubular by the lower lip of a box connector atop the dogs. When the dogs are retracted, the tubulars may be freely run through the spider.

When the dogs are extended about the tubular and a tubular connector is set down upon the dogs so as to depress one or more triggers, an interlock in a control system is actuated to prevent movement of the dogs. The triggers are preferably located on or within the dogs. However, even while the spider is thus loaded with a tubular, the dogs may nevertheless be retracted via an emergency override mechanism, which may be located on a remote control panel, for example, thereby allowing the tubular to be dropped into the wellbore. When the tubular has been lifted off of the triggers, the interlock is deactivated, and the dogs of the spider can be operated once again.

In certain exemplary embodiments, the triggers may actuate sensor valves located within the dogs. The trigger is depressed when the tubular is landed on it, thereby actuating the sensor valve, which in turn actuates an interlock in the control system.

BRIEF DESCRIPTION OF THE DRAWINGS

The invention is described in detail hereinafter on the basis of embodiments represented un the accompanying figures, in which.

DETAILED DESCRIPTION OF THE INVENTION

Figure 1A:
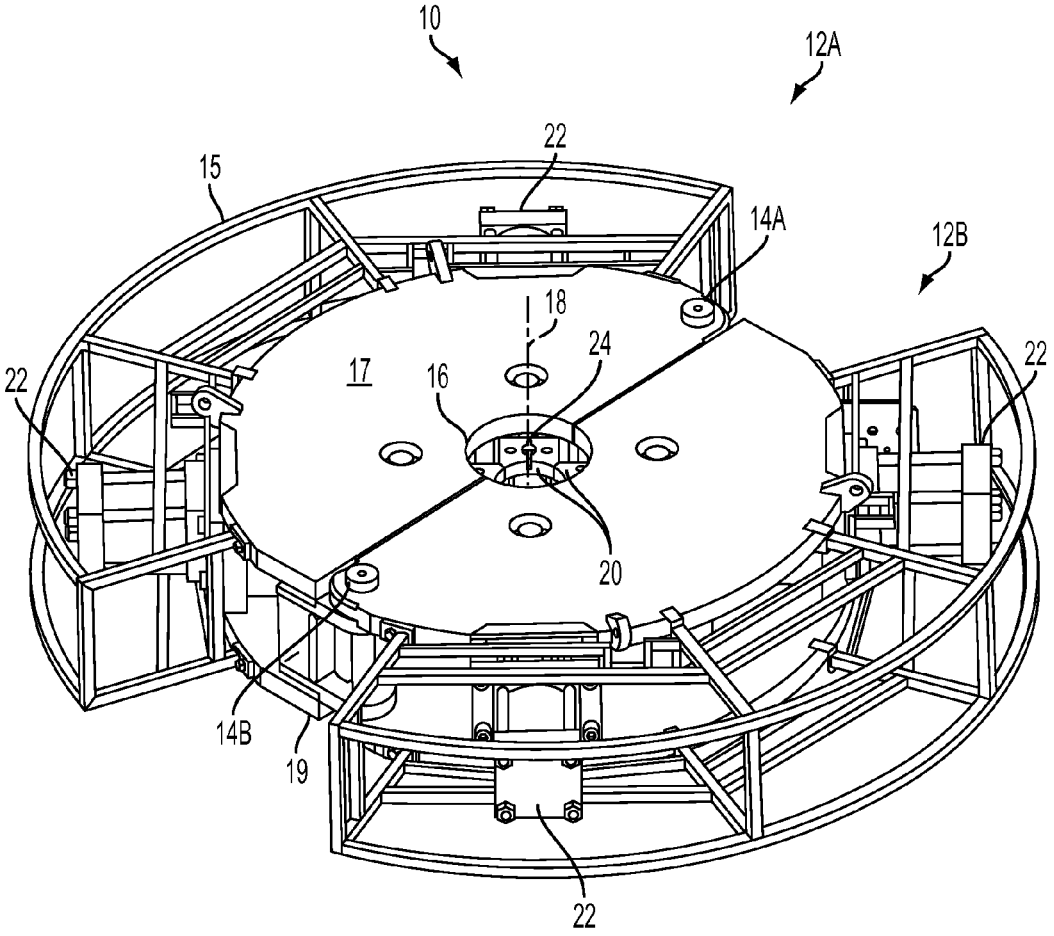
FIGS. 1A and 1B are perspective views of a two-piece hinged spider in closed and open positions, respectively, according to an exemplary embodiment of the present invention, showing a central vertical aperture formed therethrough for passage of a tubular and radially arranged dogs operated by hydraulic cylinders.

In the interest of clarity, not all features of an actual implementation or method are described in this specification. Also, the "exemplary" embodiments described herein refer to examples of the present invention. In the development of any such actual embodiment, numerous implementation-specific decisions may be made to achieve specific goals, which may vary from one implementation to another. Such would nevertheless be a routine undertaking for those of ordinary skill in the art having the benefit of this disclosure. Further aspects and advantages of the various embodiments and related methods of the invention will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

Figure 1B:
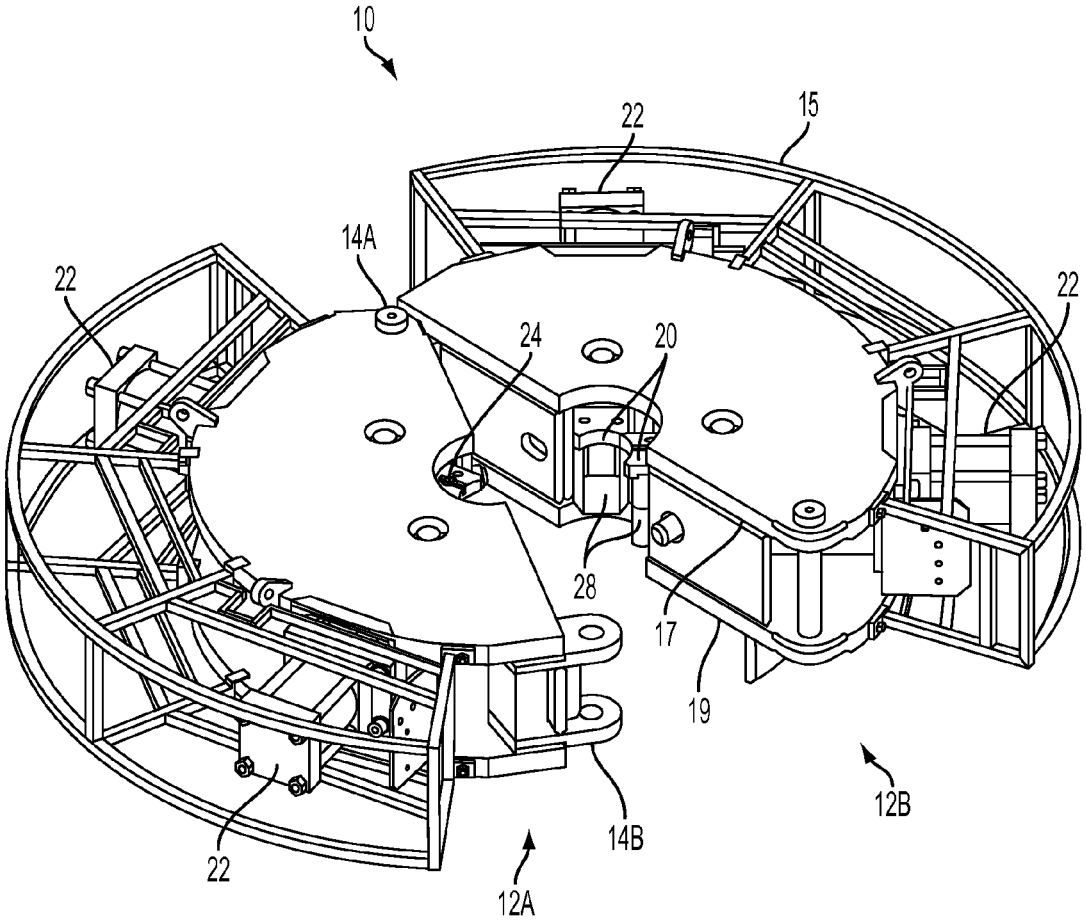

FIGS. 1A and 1B illustrate a spider 10 in closed and open positions, respectively, according to an exemplary embodiment of the invention. Spider 10 is formed by a first half 12A and second half 12B, which are pivotally connected to one another via a hinge mechanism 14A. Another hinge mechanism 14B is positioned opposite hinge mechanism 14A to thereby secure spider 10 in a closed positioned when desired. When closed, spider 10 has an opening 16 that defines a central axis 18. During operation, tubulars are extending down through opening 16 to conduct reservoir operations as known to routineers in the art.

Spider 10 includes a frame 15 that carries a plurality of dogs 20 radially positioned around opening 16. Frame 15 may be dimensioned and arranged for spider 10 to be carried atop a rotary table or the like. In certain exemplary embodiments, each dog 20 is coupled to a hydraulic cylinder 22 which actuates (retracts and extends) dog 20 into and out of opening 16 to engage and release the tubulars. Hydraulic cylinders 22 are coupled to and powered by a hydraulic power unit 120 (e.g., FIG. 7A). Upper and lower cover plates 17, 19 are attached in the center of frame 15 and provide protection for dogs 10. One or more triggers 24 and sensor valves 28 are positioned on or within dogs 20 for detection of a tubular carried by the dogs, as described in greater detail below.

Figure 2A:
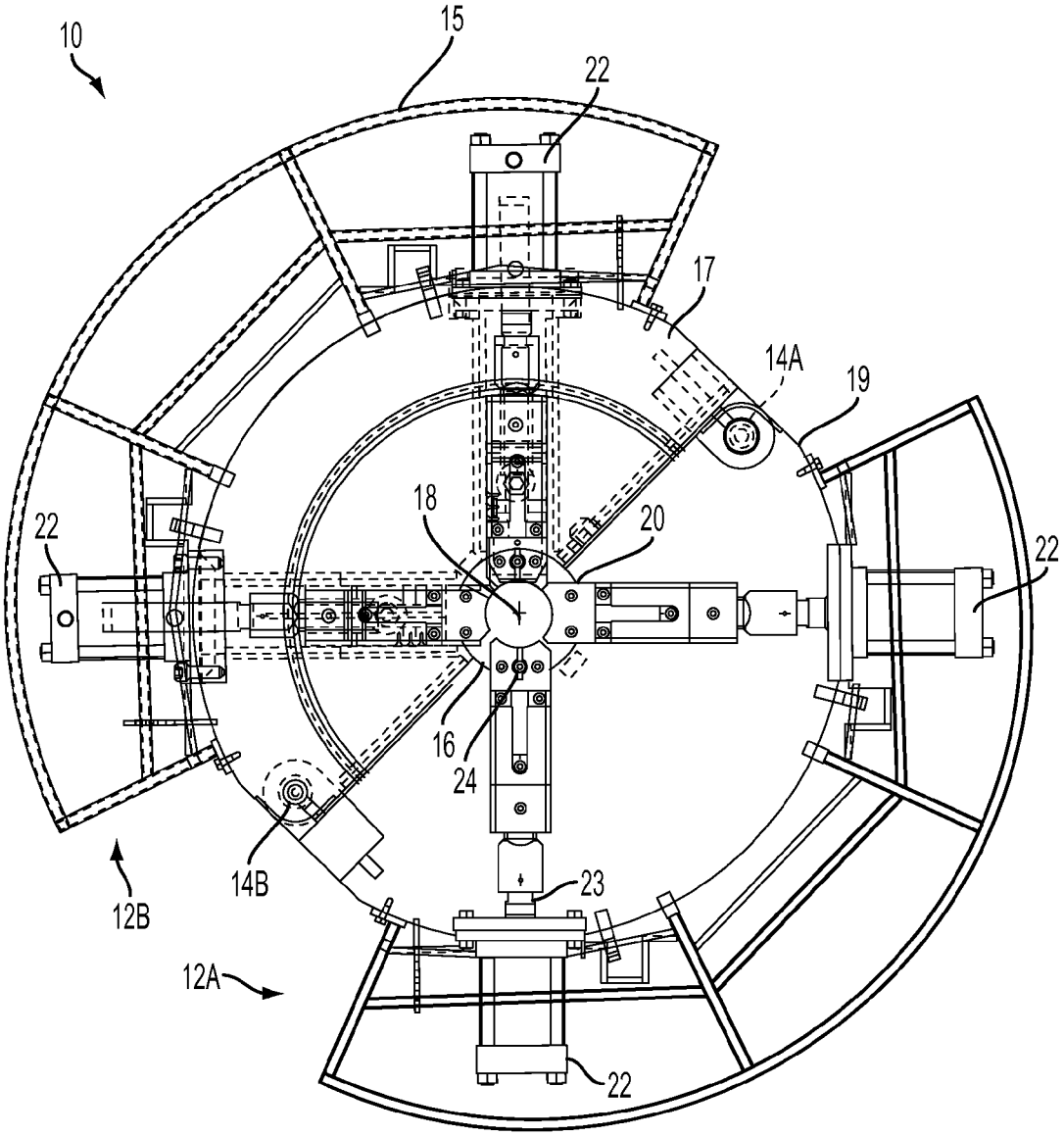
FIGS. 2A and 2B are plan views of the spider of FIG. 1A with dogs in extended and retracted positions, respectively, shown with the top cover plate of one half of the spider removed to reveal dogs and hydraulic cylinders.
Figure 2B:
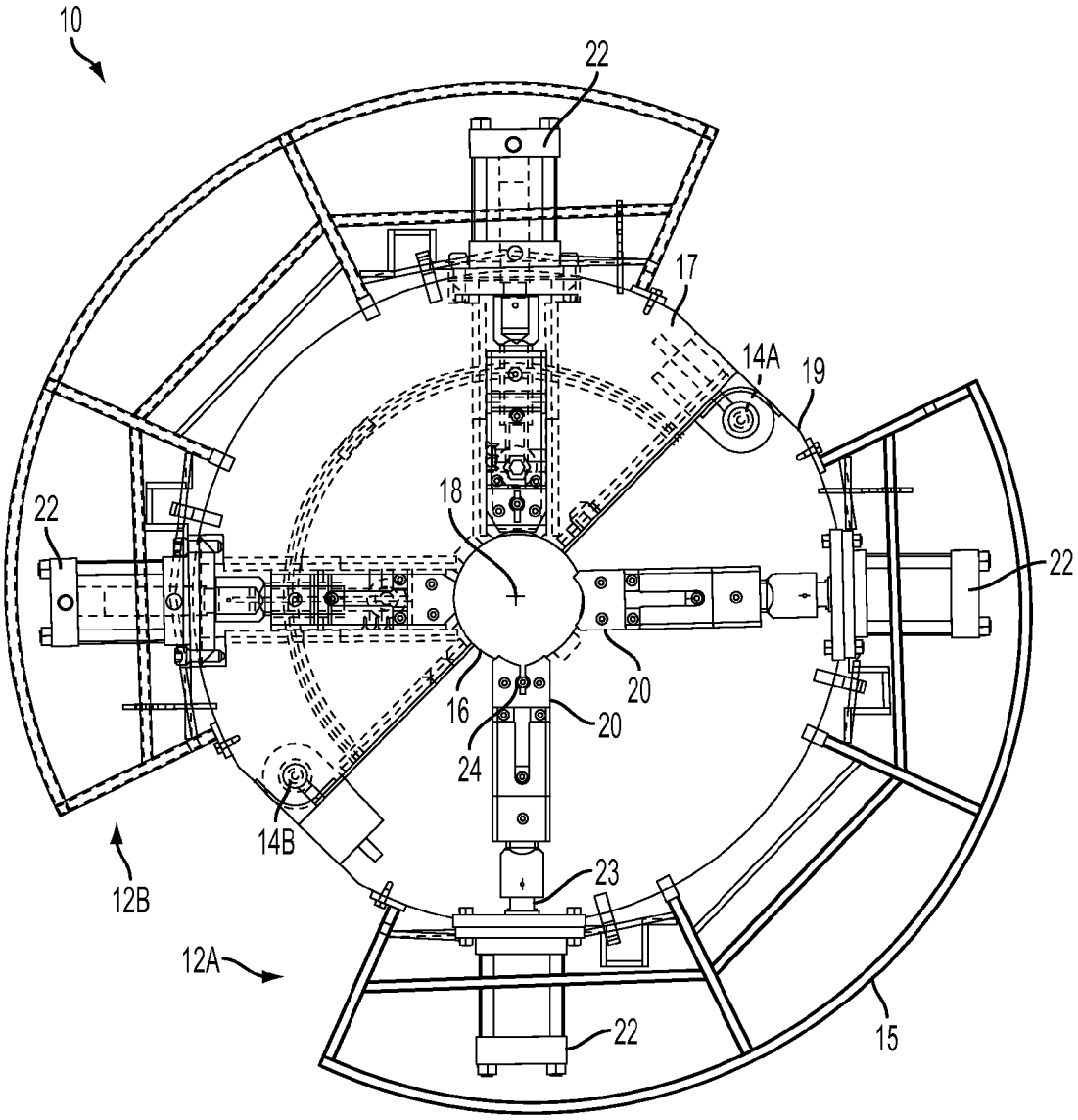
Figure 3:
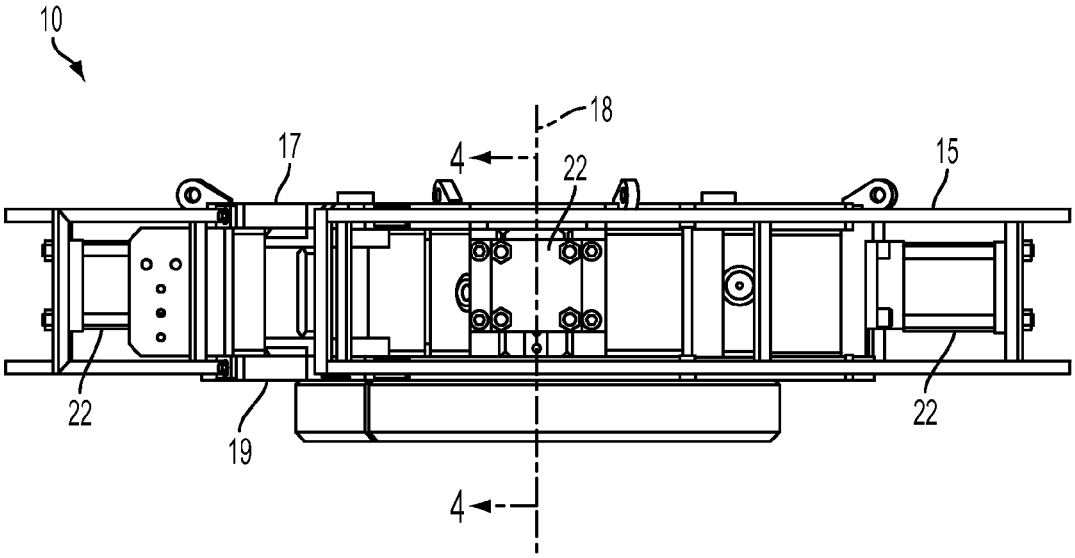
FIG. 3 is an elevation view of the spider of FIG. 2B (shown with the top cover plates of both halves of the spider installed)

FIGS. 2A and 2B are plan views that illustrate spider 10 with dogs 20 in extended and the retracted positions, respectively, according to an exemplary embodiment of the present invention. FIG. 3 is an elevation view of spider 10. Referring to FIGS. 2A-3, triggers 24 are exposed to a tubular collar when dogs 20 are extended, thus allowing activation of sensor valves 28 as described below. Although two trigger 24/sensor valve 28 pairs are shown in spider 10 having four dogs 20, other combinations may be employed as appropriate. For example, each dog 20 may have a trigger 24 and sensor valve 28. In addition, in certain exemplary embodiments, a pair of dogs 20 may be coupled to one another such that sensor valve 28 on one of the dogs works to prevent only retraction of that pair of dogs 20. Those ordinarily skilled in the art having the benefit of this disclosure realize any number of dogs, any number of triggers 24, and any number of sensor valves 28 may be utilized in various combinations.

Figure 4:
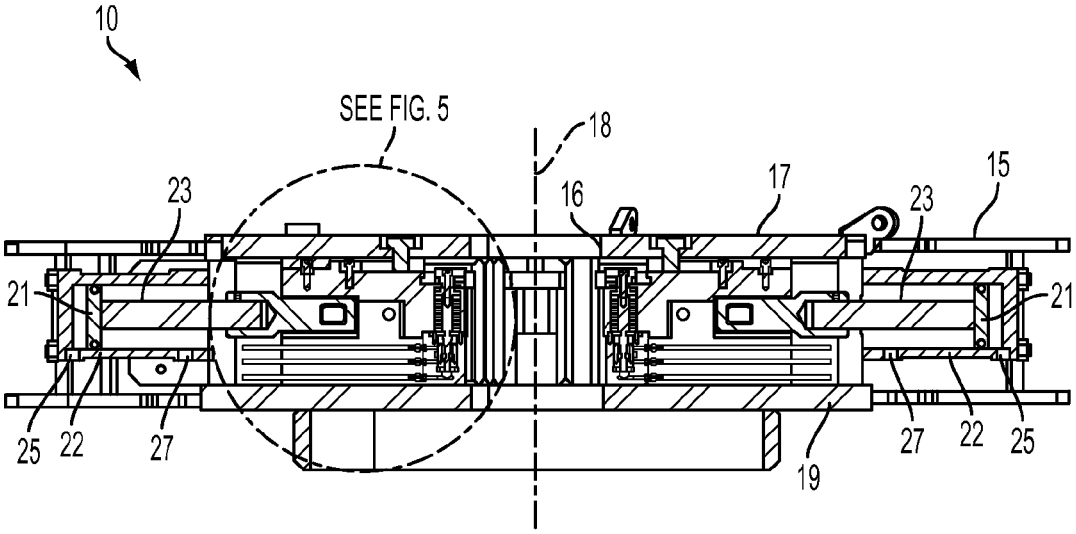
FIG. 4 is a cross section of the spider of FIG. 3 taken along section line 4-4 of FIG. 3, illustrating details of opposing dogs in the retracted position, each including a trigger for detecting the presence of a supported tubular and a sensor valve operated thereby according to an exemplary embodiment of the present invention.
Figure 5:
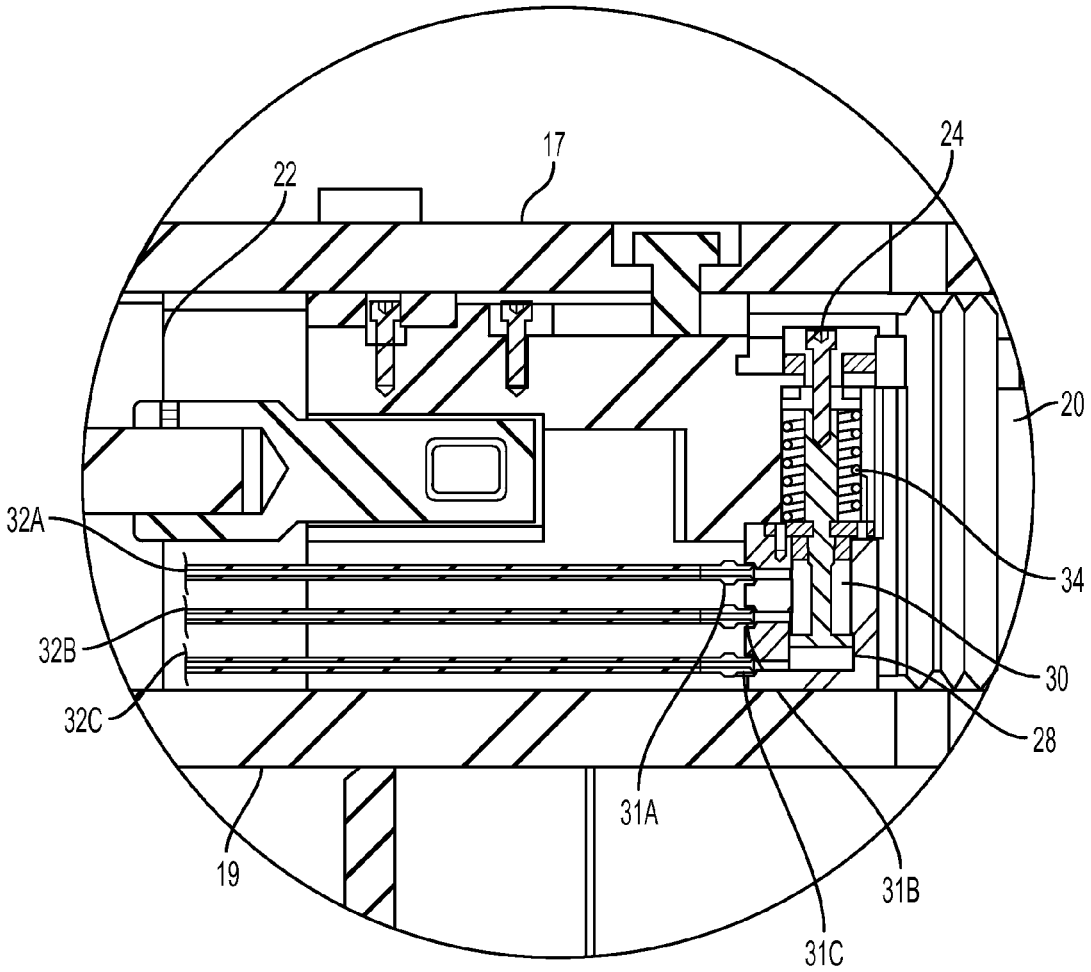
FIG. 5 is an enlarged cross section of a portion taken within line 5-5 of FIG. 4, showing details of the trigger and sensor valve according to an exemplary embodiment of the present invention.
Figure 6A:
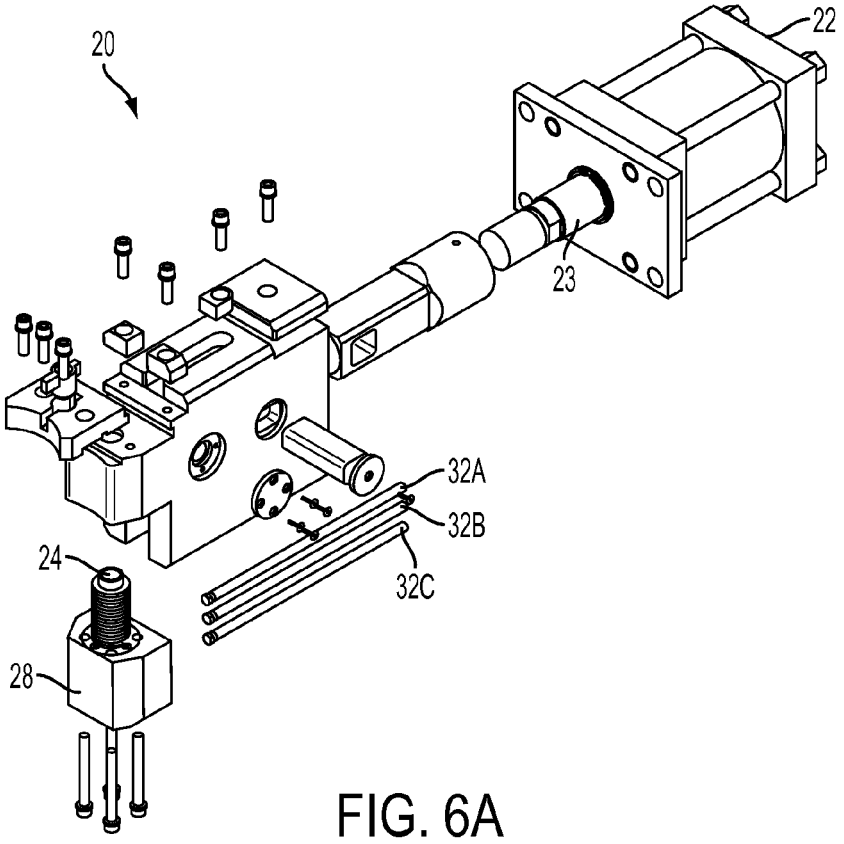
FIGS. 6A and 6B are exploded and assembled perspective views, respectively, of a dog, trigger, sensor valve, and cylinder of FIGS. 1-5.
Figure 6B:
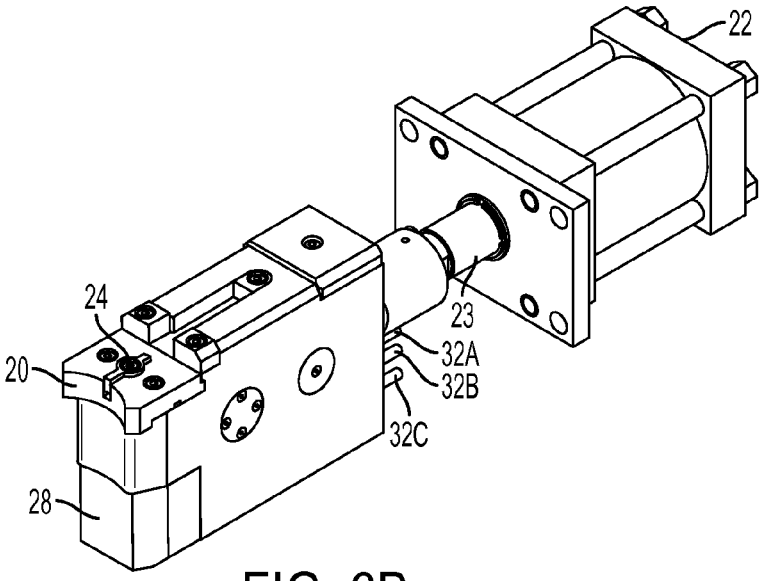

FIG. 4 is a cross section of the spider of FIG. 3 taken along section line 4-4 of FIG. 3, and FIG. 5 is an enlarged cross section of a portion taken within line 5-5 of FIG. 4. FIGS. 6A and 6B are exploded and assembled perspective views, respectively, of a dog 20 with associated trigger 24, sensor valve 28, and cylinder 22. Referring to FIGS. 4-6B collectively, the operation of spider 10, according to a preferred embodiment, is illustrated.

Each dog 20 is connected to and selectively reciprocated by actuator 22, which may by a hydraulic or pneumatic cylinder or electric actuator. In the embodiments illustrated, cylinder 22 is hydraulic. Hydraulic cylinder 22 includes a sealed piston 21 that is slideably disposed therein. Piston 21 is connected to a connecting rod 23, which is connected to dog 20. Cylinder 22 includes an expansion actuation port 25 and a retraction actuation port 27 on opposite side of piston 21, which are fluidly connected to a hydraulic power unit 120 via control system 100 (e.g., FIG. 7A).

Trigger 24 is positioned along the upper surface of dog 20 such that it is depressed by a collar of a tubular supported by dog 20 extending out into opening 16. Sensor valve 28 includes spool or poppet 30 that is actuated up and down in response to movement of trigger 24. A spring 34 is positioned around spool 30 in order to bias it, and concomitantly trigger 24, upwardly.

In a preferred embodiment, sensor valve 28 is a three-port spool or poppet valve, having an inlet port 31C, an exhaust port 31A, and an outlet port 31B. In its normally unloaded, spring-biased upward position, spool 30 fluidly couples outlet port 31B with exhaust port 31A and isolates inlet port 31C. When spool 30 is actuated in its downward position under the weight of a supported tubular, spool 30 fluidly couples outlet port 31B with inlet port 31C and isolates exhaust port 31A. Sensor valve 28 is fluidly connected to control system 100; ports 31A, 31B, and 31C are connected to conduits 32A, 32B, and 32C, respectively.

Figure 7A:
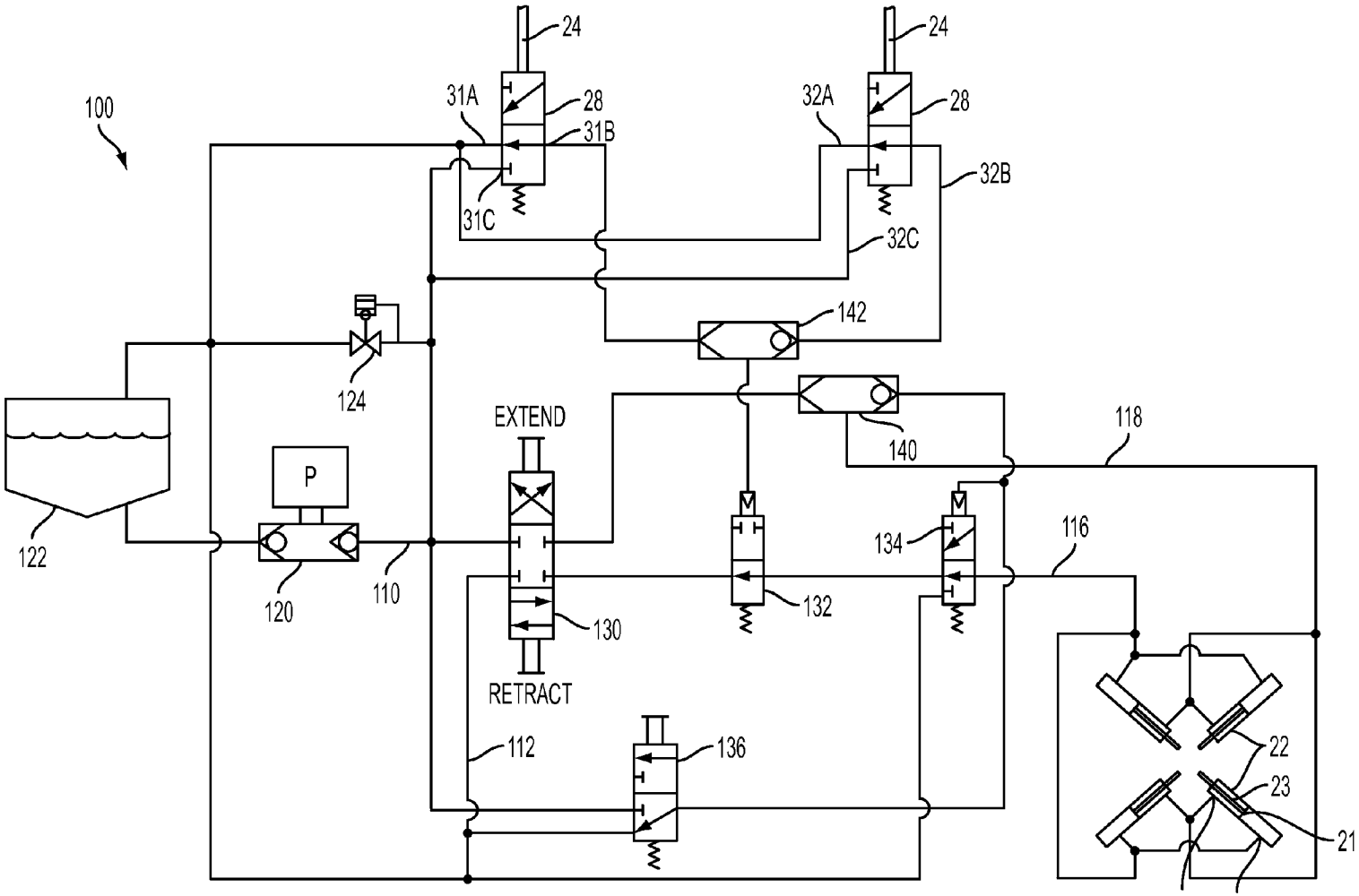
FIG. 7A is a schematic of a control system of the spider of FIGS. 1-6B according to a preferred embodiment of the invention, showing an actuation circuit, and interlock circuit, and emergency retraction circuit in the normal unloaded non-actuated operating state.

FIG. 7A is a simplified schematic of a control system 100 of spider 10 according to a preferred embodiment of the invention. Control system 100 may be implemented using hydraulic components, as shown, pneumatic components, analog and/or digital electrical, electronic, and/or optical components, or a combination of such components. For simplicity of illustration, some components, such as redundant devices, accumulators, pressure relief devices, check valves, pressure gauges, vents, drains, orifices, strainers, and isolation valves, are not illustrated.

Control system 100 includes a pressurized supply main 110 and a depressurized return main 112. One or more pumps 120 (only one is shown for simplicity) draws hydraulic fluid from a reservoir 122 and supplies pressured fluid to supply main 110. A pressure relief valve 124 is located between supply main 110 and return main 112 so as to relieve any excessive pressure in supply main 110. Control system 100 also includes a cylinder extension line 116 and a cylinder retraction line 118, which are fluidly coupled to opposite extension and retraction actuation ports 25, 27 on each of cylinders 22.

Supply and return mains 110, 112 are connected to cylinder extension and retraction lines 116, 118 by a master control valve 130. Master control valve 130 may be a manual- or solenoid-operated four-port three-way spool or poppet valve, for example. Supply main 110 and return main 112 are connected to first and second inlet ports in master control valve 130. Cylinder extension line 116 and retraction line 118 are connected to first and second outlet ports in master control valve 130.

Extension line 116 includes an interlock valve 132 and an emergency vent valve 134 located between master control valve 130 and cylinders 22. Similarly, retraction line 118 includes an emergency shuttle valve 140 located between master control valve 130 and cylinders 22. Master control valve 130 is connected to a first inlet of emergency shuttle valve 140. Cylinders 22 are connected to the outlet of emergency shuttle valve 140.

A shuttle valve has two inlet ports on opposite ends of a tubular valve body and outlet port located between the inlet ports. A ball or similar valve element is disposed and rolls freely within the valve body and is operative to block one of the two inlet ports. In this manner, a shuttle valve operates to automatically connect the inlet port having the higher pressure to the outlet port.

In an embodiment, interlock valve 132 may be a pilot-operated two-port spool or poppet valve that is connected within extension line 116 in the normally open position. When actuated, interlock valve 132 moves to a shut position so as to isolate extension line 116 and thereby fluidly lock and prevent cylinders 22 from being operated. Interlock valve 132 is operated by one or more sensing valves 28. Preferably, at least two sensing valves 28 are provided for redundancy purposes. As illustrated in FIG. 7A, a pair of sensing valves 28 may be connected to the pilot of interlock valve 132 using an interlock shuttle valve 142.

Sensing valve 28 may be manually actuated, spring-return three-port spool or poppet valve that in the non-actuated position fluidly connects the pilot of interlock valve 132 to the depressurized return main 112, via shuttle valve 142 if provided, thereby venting the pilot of interlock valve 132 so that interlock valve 132 is in the normally open position. When actuated under the weight of tubular set down upon it, sensing valve 28 fluidly connects the pressurized supply main 110 to the pilot of interlock valve 132 to actuate interlock valve 132 to the shut position.

In an embodiment, emergency vent valve 134 may be a pilot-operated three-port spool or poppet valve that is connected within extension line 116 in the normally-open configuration between its inlet and outlet ports: The inlet port of emergency vent valve 134 is connected to return main 112 at the corresponding outlet port of master control valve 130 via interlock valve 132, and the outlet port of emergency vent valve 134 is connected to cylinders 22. An exhaust port of emergency vent valve 134 is coupled return main 112 at the corresponding inlet port of master control valve 130 so that when emergency vent valve 134 is actuated, extension line 118 is exhausted to return main 112 bypassing interlock valve 132 and master control valve 130. Emergency vent valve 134 is operated by an emergency retraction valve 136.

Emergency retraction valve 136 may be a solenoid or manually actuated three-port spool or poppet valve. Emergency retraction valve 136 has in inlet port that is connected to supply main 110, and exhaust port that is connected to return main 112, and an outlet port that is connected to the pilot of emergency vent valve 134 and to the second inlet of emergency shuttle valve 140. In its normal, non-actuated position, emergency retraction valve 136 fluidly coupled its outlet port to its exhaust port, thereby venting the pilot of emergency vent valve 134.

FIG. 7A illustrates control system 100 in a normal unloaded state in which a tubular is not set down upon dogs 20 (FIGS. 1-6B) and trigger(s) 24. Operation of control system 100 in this state is as follows:

In a deactivated center position, master control valve 130 may isolate supply and return mains 110, 112 and extension and retraction lines 116, 118 so that cylinders 22 remain fluidly locked in their present position, whatever that might be. Any over-pressurized fluid in supply main 110 is vented to return main 112 via pressure relief valve 124.

In order to extend cylinders 22, master control valve 130 is positioned to the extend position, which connects supply main 110 to extension line 116 and return main 112 to retraction line 118. Pressurized fluid flows from supply main 110, through master control valve 130, into extension line 116, through interlock valve 132 and emergency vent valve 134, and into the extension actuation ports 25 in cylinders 22. Return fluid from the opposite sides of the pistons 21 in cylinders 22 exits retraction actuation ports 27 and flows within retraction line 118 into emergency shuttle valve 140. Depending on the position of emergency shuttle valve 140, the return fluid may continue through retraction line 118 and through master control valve 130 to return main 112, or it may flow through emergency retraction valve 136 to return main 112.

In order to retract cylinders 22, master control valve 130 is positioned to the retract position, which connects supply main 110 to retraction line 118 and return main 112 to extension line 116. Pressurized fluid flows from supply main 110, through master control valve 130, into retraction line 118, through emergency shuttle valve 140, and into the retraction actuation ports 27 in cylinders 22. Return fluid from the opposite sides of the pistons 21 in cylinders 22 exits extension ports 25 and flows into extension line 116, through emergency vent valve 134, interlock valve 132, and master control valve 130, to return main 112.

In another embodiment (not expressly illustrated), control system 100 may be arranged to completely isolate pump 120 from both extension and retraction ports of 25, 27 of cylinders 22 when a tubular is set down upon dogs 20 (FIGS. 1-6B) and trigger(s) 24, thereby disabling both retraction and extension of dogs 20 when under load. As such a control system arrangement is within the ordinary skill of a routineer in the art, further details are not provided herein for brevity.

Figure 7B:
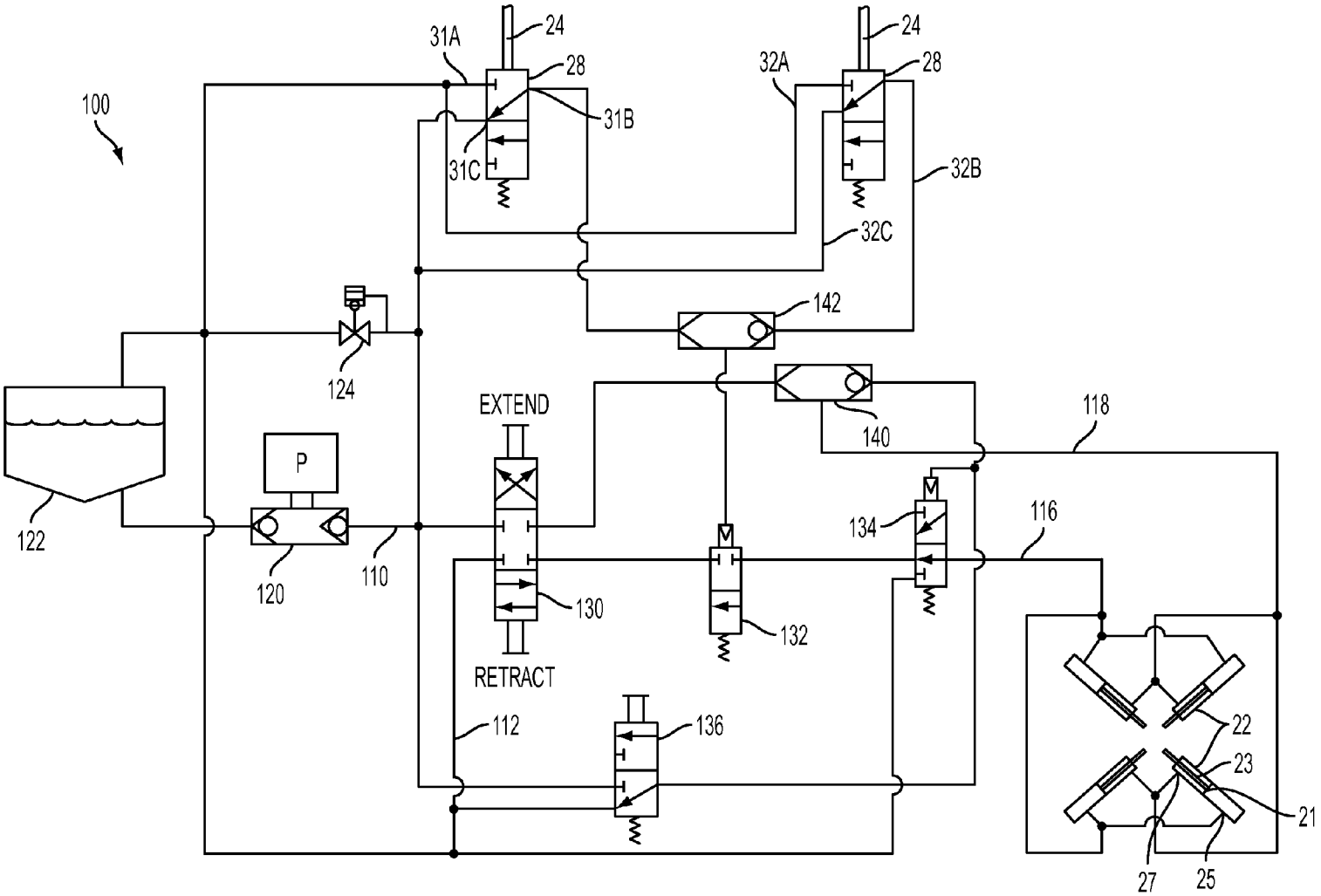
FIG. 7B is a schematic of the control system of FIG. 7A, showing the interlock circuit in a loaded, actuated state so as to prevent operation of the cylinders.

FIG. 7B illustrates control system 100 in a loaded state in which a tubular is set down upon dogs 20 (FIGS. 1-6B) and trigger(s) 24. Sensing valves 28 are actuated, which in turn actuates interlock valve 132. In this state, regardless of whether or not master control valve is actuated in the extend or retract positions, cylinders 22 are fluidly locked in their present position. Any over-pressurized fluid in supply main 110 is vented to return main 112 via pressure relief valve 124.

Figure 7C:
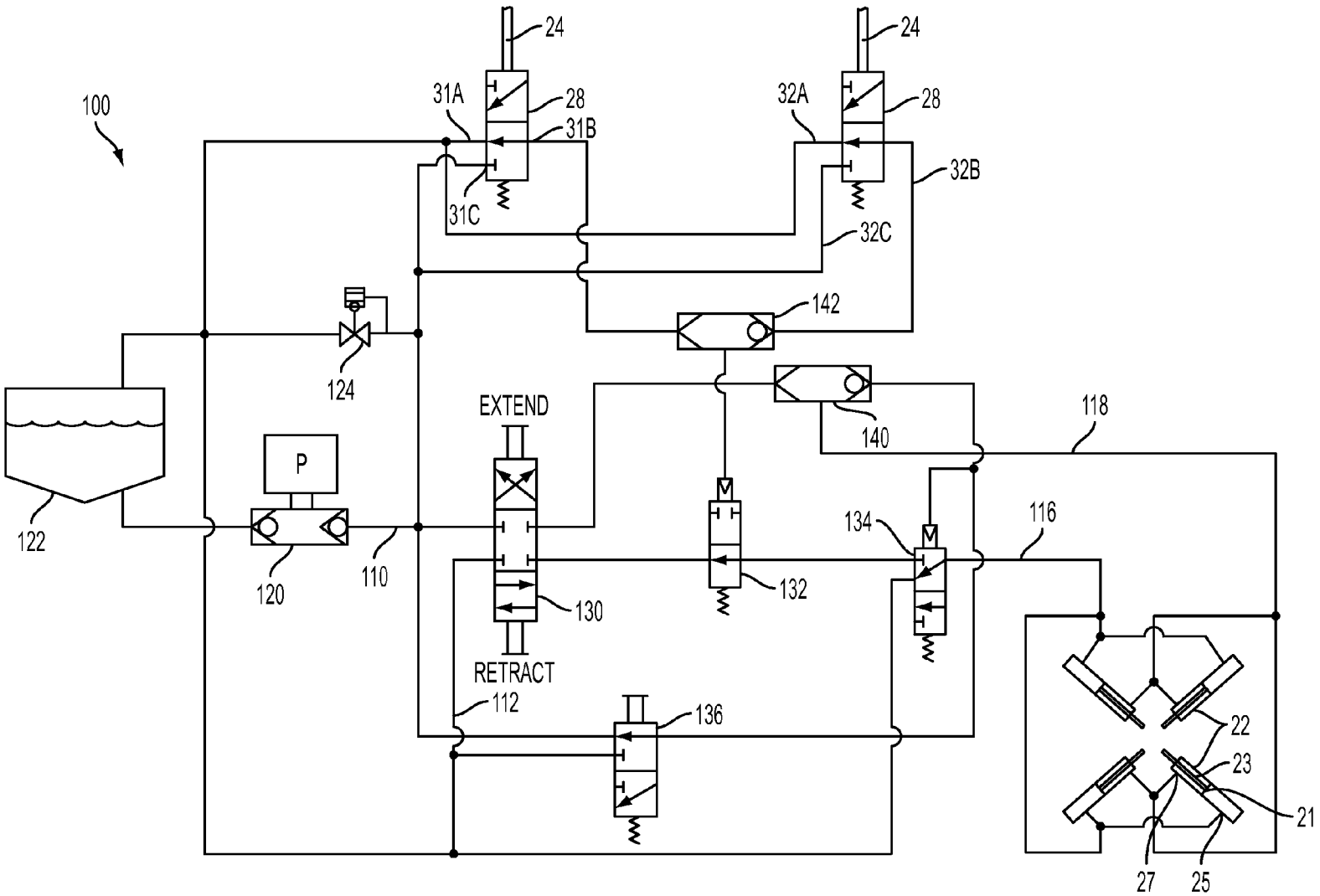
FIG. 7C is a schematic of the control system of FIG. 7A, showing the emergency retraction circuit in actuated state so as to retract the cylinders regardless of whether or not the spider is carrying a tubular.

FIG. 7C illustrates control system 100 in an emergency state in which emergency retract valve 136 is actuated. Pressurized fluid from supply main 110 flows through emergency retract valve 136, which both actuates emergency vent valve 134 and supplies pressurized fluid to the retraction actuation ports 27 of cylinders 22 via emergency shuttle valve 140 and a portion of retraction line 118. Return fluid from the opposite sides of the pistons 21 in cylinders 22 exits retraction ports 25 and flows into extension line 116, through emergency vent valve 134, and directly to return main 112, thereby retracting cylinders 22. In this manner, control system 100 allows cylinders 22 to be retracted in an emergency situation regardless of whether sensor valves 28 are unloaded, as shown in FIG. 7C, or loaded, as shown in FIG. 7B.

Figure 8:
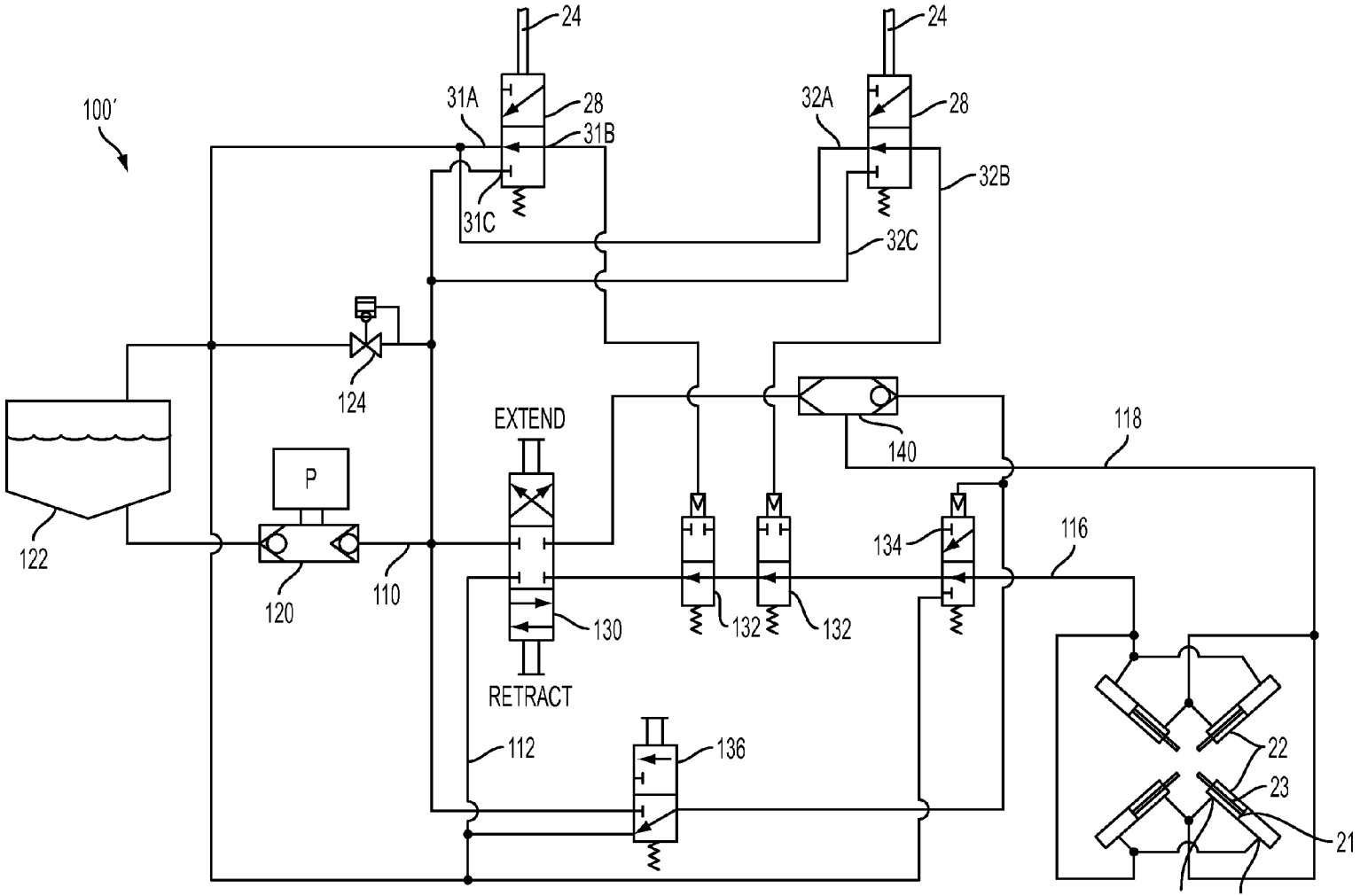
FIG. 8 is a schematic of a control system of the spider of FIGS. 1-6B according to a first alternative embodiment of the invention, showing an actuation circuit, and interlock circuit, and emergency retraction circuit in the normal unloaded non-actuated operating state.

FIG. 8 is a schematic of a control system 100' of the spider 10 of FIGS. 1-6B according to an alternative embodiment of the invention. Control system 100' of FIG. 8 is substantially the same as control system 100 of FIG. 7A, except that interlock shuttle valve 142 is removed, and each sensor valve 28 directly controls the actuation of an associated interlock valve 132. Interlock valves 132 are connected in series within extension line 116.

Figure 9:
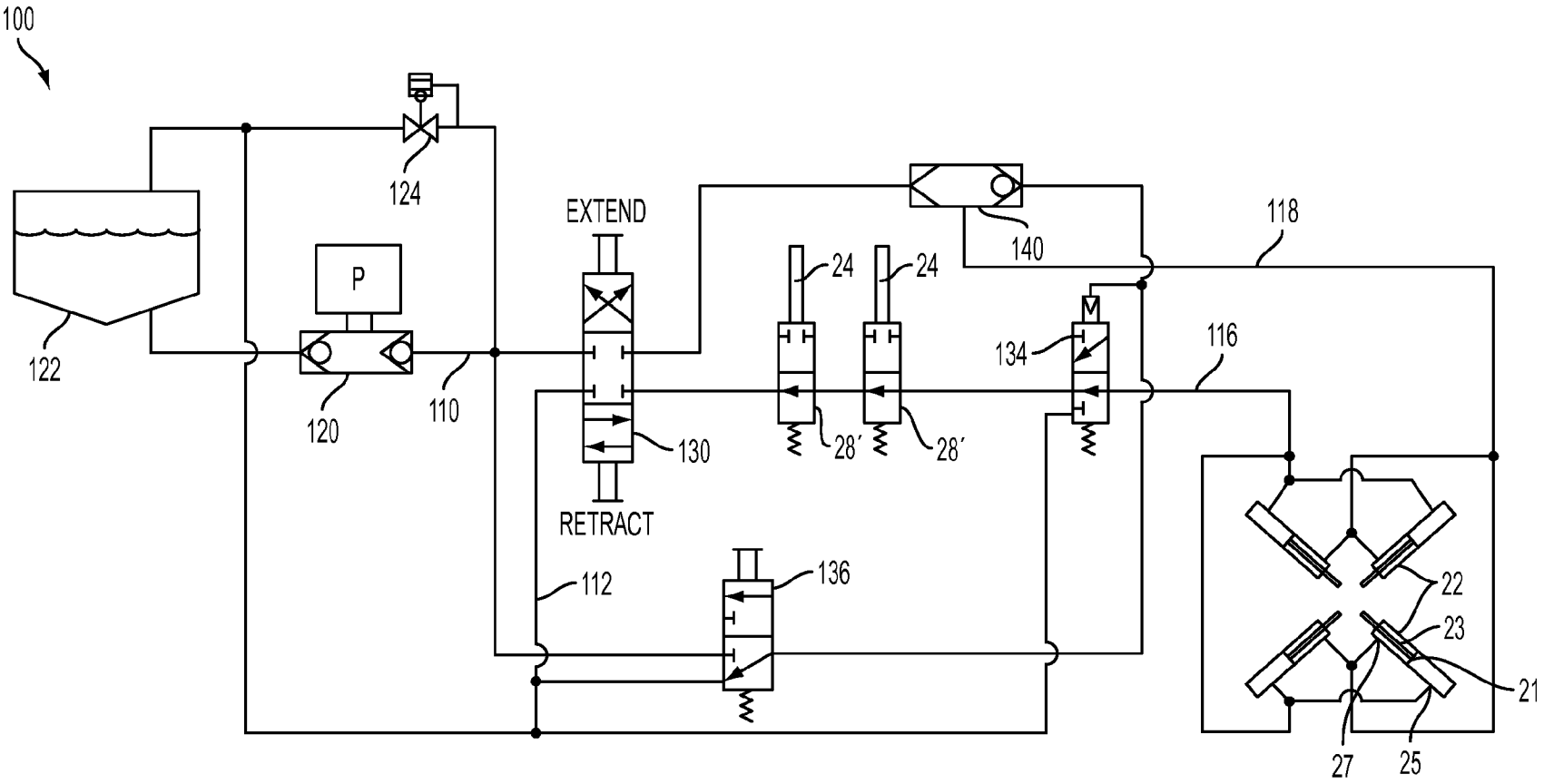
FIG. 9 is a schematic of a control system of the spider of FIGS. 1-6B according to a second alternative embodiment of the invention, showing an actuation circuit, and interlock circuit, and emergency retraction circuit in the normal unloaded non-actuated operating state.

FIG. 9 is a schematic of a control system 100" of the spider 10 of FIGS. 1-6B according to yet another alternative embodiment of the invention. Control system 100" of FIG. 9 is substantially the same as control system 100' of FIG. 8, except that sensor valves 28 and interlock valves 132 are replaced by sensor valves 28', which are physically located in dogs 20 (FIGS. 1-6B) and operated by triggers 24, but which are directly connected within extension line 116. Sensor valves 28' may be simple mechanically operated two-port normally open spool or poppet isolation valves.

In summary, a spider and a method for vertically supporting a tubular have been described. Embodiments of the spider may generally have: A frame defining a vertical axis therethrough; at least one actuator carried by the frame; a plurality of dogs radially disposed about the vertical axis, the plurality of dogs coupled to the at least one actuator so as to be movable by the at least one actuator between an inward extended position and an outward retracted position, the plurality of dogs arranged so that when in the extended position, a tubular coaxial with the vertical axis may be vertically supported by the plurality of dogs; a first trigger located on a first of the plurality of dogs so that the tubular influences the first trigger from a first state when the tubular is not vertically supported by the plurality of dogs to a second state when the tubular is vertically supported by the plurality of dogs; and a control system operatively coupled between the first trigger and the at least one actuator, the control system including a first selector operative to selectively move the plurality of dogs by the at least one actuator between the extended position and the retracted position when the first trigger is in the first state and to prevent movement of the plurality of dogs by the at least one actuator when the first trigger is in the second state. Embodiments of the method may generally include: Providing a spider with an opening formed therethrough that defines a vertical axis, the spider including at least one actuator and a plurality of dogs radially disposed about the vertical axis and coupled to the at least one actuator so as to be movable between an inward extended position and an outward retracted position; positioning using a first selector the plurality of dogs to the retracted position; running the tubular through the opening; positioning using the first selector the plurality of dogs to the extended position; vertically supporting the tubular by the plurality of dogs; influencing by the vertically supported tubular a first trigger located on a first of the plurality of dogs; and then preventing by the influenced first trigger positioning the plurality of dogs to the retracted position using the first selector.

Any of the foregoing embodiments may include any one of the following elements or characteristics, alone or in combination with each other: A second selector operative to selectively move the plurality of dogs by the at least one actuator to the retracted position regardless of whether the trigger is in the first state or the second state; a sensor valve disposed within the first of the plurality of dogs and operatively coupled to the first trigger; a second trigger located on a second of the plurality of dogs so that the tubular influences the second trigger from an unloaded state when the tubular is not vertically supported by the plurality of dogs to a loaded state when the tubular is vertically supported by the plurality of dogs; the control system is operatively coupled between the second trigger and the at least one actuator; the control system is designed and arranged to allow the first selector to selectively move the plurality of dogs by the at least one actuator between the extended position and the retracted position when the first trigger is in the first state and the second trigger is in the unloaded state; the control system is designed and arranged to prevent movement of the plurality of dogs by the at least one actuator when the first trigger is in the second state or the second trigger is in the loaded state; the first and second selectors are valves; a source of pressurized fluid fluidly coupled to an inlet of the first selector, the at least one actuator fluidly coupled to an outlet of the first selector; the sensor valve is fluidly coupled between the first selector and the at least one actuator; the control system is arranged to completely isolate the source of pressurized fluid from the at least one actuator when the first trigger is in the second state; a source of pressurized fluid fluidly coupled to an inlet of the first selector, the at least one actuator fluidly coupled to an outlet of the first selector; an interlock valve fluidly coupled between the first selector and the at least one actuator; the sensor valve is fluidly coupled to the interlock valve so as to open and shut the interlock valve; providing a second selector to selectively move the plurality of dogs by the at least one actuator to the retracted position when the first trigger is influenced by the vertically supported tubular; disposing a sensor valve within the first of the plurality of dog; actuating the sensor valve by the first trigger when the first trigger is influenced by the vertically supported tubular; providing a second trigger located on a second of the plurality of dogs; influencing by the vertically supported tubular the second trigger located on the second of the plurality of dogs; preventing by the influenced second trigger positioning the plurality of dogs to the retracted position using the first selector; allowing by the first and second triggers the first selector to selectively move the plurality of dogs by the at least one actuator between the extended position and the retracted position when the tubular is not vertically supported by the plurality of dogs; preventing movement of the plurality of dogs by the at least one actuator when at least the first trigger or the second trigger is influenced by the vertically supported tubular; the first and second selectors are valves; coupling a source of pressurized fluid to the at least one actuator via the first selector; isolating the source of pressurized fluid from the at least one actuator by the sensor valve when the first trigger is influenced by the vertically supported tubular; coupling a source of pressurized fluid to the at least one actuator via the first selector; and isolating the source of pressurized fluid from the at least one actuator by an interlock valve that is actuated by the sensor valve when the first trigger is influenced by the vertically supported tubular.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A spider for vertically supporting a tubular, comprising:

a frame defining a vertical axis therethrough;

at least one actuator carried by said frame;

a plurality of dogs radially disposed about said vertical axis, said plurality of dogs coupled to said at least one actuator so as to be movable by said at least one actuator between an inward extended position and an outward retracted position, said plurality of dogs arranged so that when in said extended position, a tubular coaxial with said vertical axis may be vertically supported by said plurality of dogs;

a first trigger located on a first of said plurality of dogs so that said tubular influences said first trigger from a first state when said tubular is not vertically supported by said plurality of dogs to a second state when said tubular is vertically supported by said plurality of dogs; and a control system operatively coupled between said first trigger and said at least one actuator, said control system including a first selector operative to selectively move said plurality of dogs by said at least one actuator between said extended position and said retracted position when said first trigger is in said first state and to prevent movement of said plurality of dogs by said at least one actuator when said first trigger is in said second state.

2. The spider of claim 1 wherein said control system further comprises:

a second selector operative to selectively move said plurality of dogs by said at least one actuator to said retracted position regardless of whether said trigger is in said first state or said second state.

3. The spider of claim 1 wherein said control system further comprises:

a sensor valve disposed within said first of said plurality of dogs and operatively coupled to said first trigger.

4. The spider of claim 1 further comprising:

a second trigger located on a second of said plurality of dogs so that said tubular influences said second trigger from an unloaded state when said tubular is not vertically supported by said plurality of dogs to a loaded state when said tubular is vertically supported by said plurality of dogs; wherein said control system is operatively coupled between said second trigger and said at least one actuator;

said control system is designed and arranged to allow said first selector to selectively move said plurality of dogs by said at least one actuator between said extended position and said retracted position when said first trigger is in said first state and said second trigger is in said unloaded state; and said control system is designed and arranged to prevent movement of said plurality of dogs by said at least one actuator when said first trigger is in said second state or said second trigger is in said loaded state.

5. The spider of claim 2 wherein:

said first and second selectors are valves.

6. The spider of claim 3 wherein said control system further comprises:

a source of pressurized fluid fluidly coupled to an inlet of said first selector, said at least one actuator fluidly coupled to an outlet of said first selector; wherein said sensor valve is fluidly coupled between said first selector and said at least one actuator.

7. The spider of claim 6 wherein:

said control system is arranged to completely isolate said source of pressurized fluid from said at least one actuator when said first trigger is in said second state.

8. The spider of claim 3 wherein said control system further comprises:

a source of pressurized fluid fluidly coupled to an inlet of said first selector, said at least one actuator fluidly coupled to an outlet of said first selector; and an interlock valve fluidly coupled between said first selector and said at least one actuator; wherein said sensor valve is fluidly coupled to said interlock valve so as to open and shut said interlock valve.

9. A method for vertically supporting a tubular, comprising the steps of:

providing a spider with an opening formed therethrough that defines a vertical axis, said spider including at least one actuator and a plurality of dogs radially disposed about said vertical axis and coupled to said at least one actuator so as to be movable between an inward extended position and an outward retracted position;

positioning using a first selector said plurality of dogs to said retracted position;

running said tubular through said opening;

positioning using said first selector said plurality of dogs to said extended position;

vertically supporting said tubular by said plurality of dogs;

influencing by said vertically supported tubular a first trigger located on a first of said plurality of dogs; and then preventing by said influenced first trigger positioning said plurality of dogs to said retracted position using said first selector.

10. The method of claim 9 further comprising the step of:

providing a second selector to selectively move said plurality of dogs by said at least one actuator to said retracted position when said first trigger is influenced by said vertically supported tubular.

11. The method of claim 9 further comprising the steps of:

disposing a sensor valve within said first of said plurality of dog; and actuating said sensor valve by said first trigger when said first trigger is influenced by said vertically supported tubular.

12. The method of claim 9 further comprising the steps of:

providing a second trigger located on a second of said plurality of dogs;

influencing by said vertically supported tubular said second trigger located on said second of said plurality of dogs; and preventing by said influenced second trigger positioning said plurality of dogs to said retracted position using said first selector.

13. The method of claim 12 further comprising the steps of:

allowing by said first and second triggers said first selector to selectively move said plurality of dogs by said at least one actuator between said extended position and said retracted position when said tubular is not vertically supported by said plurality of dogs; and preventing movement of said plurality of dogs by said at least one actuator when at least said first trigger or said second trigger is influenced by said vertically supported tubular.

14. The method of claim 10 wherein:

said first and second selectors are valves.

15. The method of claim 11 further comprising the steps of:

coupling a source of pressurized fluid to said at least one actuator via said first selector; and isolating said source of pressurized fluid from said at least one actuator by said sensor valve when said first trigger is influenced by said vertically supported tubular.

16. The method of claim 11 further comprising the steps of:

coupling a source of pressurized fluid to said at least one actuator via said first selector; and isolating said source of pressurized fluid from said at least one actuator by an interlock valve that is actuated by said sensor valve when said first trigger is influenced by said vertically supported tubular.

* * * * *